US005321962A

United States Patent [19]

Ferchau et al.

[11] Patent Number: 5,321,962

[45] Date of Patent: Jun. 21, 1994

[54] INJECTOR/EJECTOR LATCH LOCK MECHANISM

[76] Inventors: Joerg U. Ferchau, 1825 Shady Hollow Dr., Morgan Hill, Calif. 95037; Melvin J. Phillips, 20975 Valley Green Dr., #222, Cupertino, Calif. 95014

[21] Appl. No.: 6,188

[22] Filed: Jan. 19, 1993

Related U.S. Application Data

[63] Continuation of Ser. No. 752,102, Aug. 29, 1991, abandoned.

[51] Int. Cl.[5] ..... E05B 13/10

[52] U.S. Cl. ..... 70/208; 361/726; 70/225; 70/DIG. 13; 70/58

[58] Field of Search ..... 70/224, 201, 208, DIG. 13, 70/153, 484, 137, 215, 477, 474, 467, 489, 478, 469, 58; 292/336.3, DIG. 31; 200/50 R; 361/725, 726 X

[56] References Cited

U.S. PATENT DOCUMENTS

| | | | |
|---|---|---|---|
| 2,300,102 | 10/1942 | Christensen . | |
| 2,832,857 | 4/1958 | Landmeier . | |
| 3,044,815 | 7/1962 | Soss | 70/484 |
| 3,109,899 | 11/1963 | Pastene . | |
| 3,575,482 | 4/1971 | MacMaster . | |
| 3,919,507 | 11/1975 | Middleton, Jr. . | |
| 3,932,716 | 1/1976 | Mottel et al. . | |
| 4,071,722 | 1/1978 | Hart . | |
| 4,134,281 | 1/1979 | Pelcin | 292/DIG. 31 |
| 4,268,077 | 5/1981 | Bohleen et al. | 292/DIG. 31 |
| 4,276,458 | 6/1981 | Alter . | |
| 4,300,030 | 11/1981 | Dimarco et al. . | |
| 4,391,589 | 7/1983 | Monfredo et al. | 433/63 |
| 4,435,624 | 3/1984 | Sepulveda . | |
| 4,467,152 | 8/1984 | Gordy . | |
| 4,468,544 | 8/1984 | Wainess et al. . | |
| 4,510,779 | 4/1985 | Ahad | 70/208 |
| 4,563,552 | 1/1986 | Fushimoto . | |
| 4,596,907 | 6/1986 | LaGreco et al. . | |
| 4,716,495 | 12/1987 | Craker . | |
| 4,736,649 | 4/1988 | Beun | 70/208 |
| 4,777,332 | 10/1988 | Diaz . | |
| 4,858,970 | 8/1989 | Tedesco et al. | 292/DIG. 31 |
| 4,885,436 | 12/1989 | Pham et al. . | |
| 4,931,907 | 5/1990 | Robinson . | |

FOREIGN PATENT DOCUMENTS 0038583 10/1981 European Pat. Off. .

OTHER PUBLICATIONS

Promotional material entitled "H2142 Compensating Keeper," (LLH-3) The Hartwell Corporation.

Promotional material entitled "Chassis Latches, 21L/40L Series," (M-4) Camloc.

Promotional material entitled "Chassis Latches, 21L/40L Series," (M-5) Camloc.

Promotional material entitled "Chassis Latches, 61L Series," (M-9) Camloc.

Promotional material entitled "Chassis Latches, 61L Series," (M-1) Camloc.

Promotional material entitled "Chassis Latches, 61L Series," (M-11) Camloc.

*Primary Examiner*—Peter M. Cuomo

*Assistant Examiner*—Darnell M. Boucher

*Attorney, Agent, or Firm*—Townsend and Townsend Khourie and Crew

[57] ABSTRACT

A latch/ejector mechanism (2), designed for use with components (6) such as power supplies, computer modules and circuit boards, is used to secure a component to and release the component from a housing (104) by engaging and disengaging a catch element (96) on the housing. The mechanism includes a handle (8) pivotally mounted to the component for moving between latched and unlatched positions. The handle has a latch (94) at one end (28) which engages with and disengages from the catch element during such pivotal movement of the handle. The mechanism also includes a trigger (10) which must be actuated to permit the handle to be moved from the latched position to the unlatched position. A security lock (12), movable between locked and unlocked positions, is used to prevent the actuation of the trigger. In the locked position the lock surface (86) of the security lock opposes a portion of the trigger, called a prevent element (90). However, moving the lock to the unlocked position causes the lock surface of the security lock to be misaligned with the prevent element to permit unimpeded movement of the trigger element thus permitting actuation of the trigger element to release the handle.

10 Claims, 3 Drawing Sheets

INJECTOR/EJECTOR LATCH LOCK MECHANISM

This is a continuation of application Ser. No. 07/752,102, filed Aug. 29, 1991, now abandoned.

BACKGROUND OF THE INVENTION

Various types of latching and ejecting mechanisms are used to secure components to housings. For example, see U.S. Pat. No. 4,931,907 which discloses a latch assembly particularly useful for mounting an electronic module to a housing.

Conventional latch assemblies typically include a handle pivotally mounted to the component. The handle has a latch element at one end defining a U-shaped opening. The U-shaped opening is positioned and sized to engage a catch element on the housing. Upon insertion of the component into the housing, the use of the latch assembly allows the latch to engage the catch element on the housing and, through the mechanical advantage created by the handle, securely seat the component within the housing. The latch is also configured so that pivoting the handle in the reverse direction during extraction causes the component to be partially extracted by engagement of a latch with the catch element, again aided by the mechanical advantage inherent with using the handle.

SUMMARY OF THE INVENTION

The present invention is directed to a latch/ejector mechanism which incorporates a simple yet effective security lock to help prevent unauthorized removal of a component from a housing.

The latch/ejector mechanism is designed for use with components, such as power supplies, computer modules and circuit boards. The latch/ejector mechanism is used to secure the component to and release the component from the housing by engaging and disengaging a catch element on the housing. The mechanism includes a handle pivotally mounted to the component for moving between latched and unlatched positions. The handle has a latch at one end which engages with and disengages from the catch element of the housing during such pivotal movement of the handle.

The mechanism also includes a trigger which must be actuated to permit the handle to be moved from the latched position to the unlatched position. A security lock, movable between locked and unlocked positions, is used to prevent the actuation of the trigger. In the locked position the locked surface of the security lock opposes a portion of the trigger, called a prevent element. However, moving the lock to the unlocked position causes the lock surface of the security lock to be misaligned with the prevent element to permit unimpeded movement of the trigger element thus permitting actuation of the trigger element to release the handle.

A primary advantage of the invention is that an appropriate level of security against inadvertent and unauthorized removal of a component from a housing is provided with a simple mechanism. Although sophisticated key/lock systems could be used, this is not found to be generally necessary. Rather, providing a relatively nonstandard shaped keyhole, such as pentagonal, to accept a simple but specially manufactured key is considered a sufficient level of security for many situations. Of course, where tighter security is needed, other, more sophisticated key/lock arrangements can be used.

Another advantage of the invention is that the security lock is unobtrusive and does not detract from the overall appearance of the mechanism. Since the security lock is part of the mechanism itself, it can often be protected from tampering and assault by the rest of the latch/ejector mechanism.

Other features and advantages of the invention will appear from the following description in which the preferred embodiment has been described in detail in conjunction with the accompanying drawings.

DETAILED DESCRIPTION OF THE PREFERRED EMBODIMENT

Figure 1:
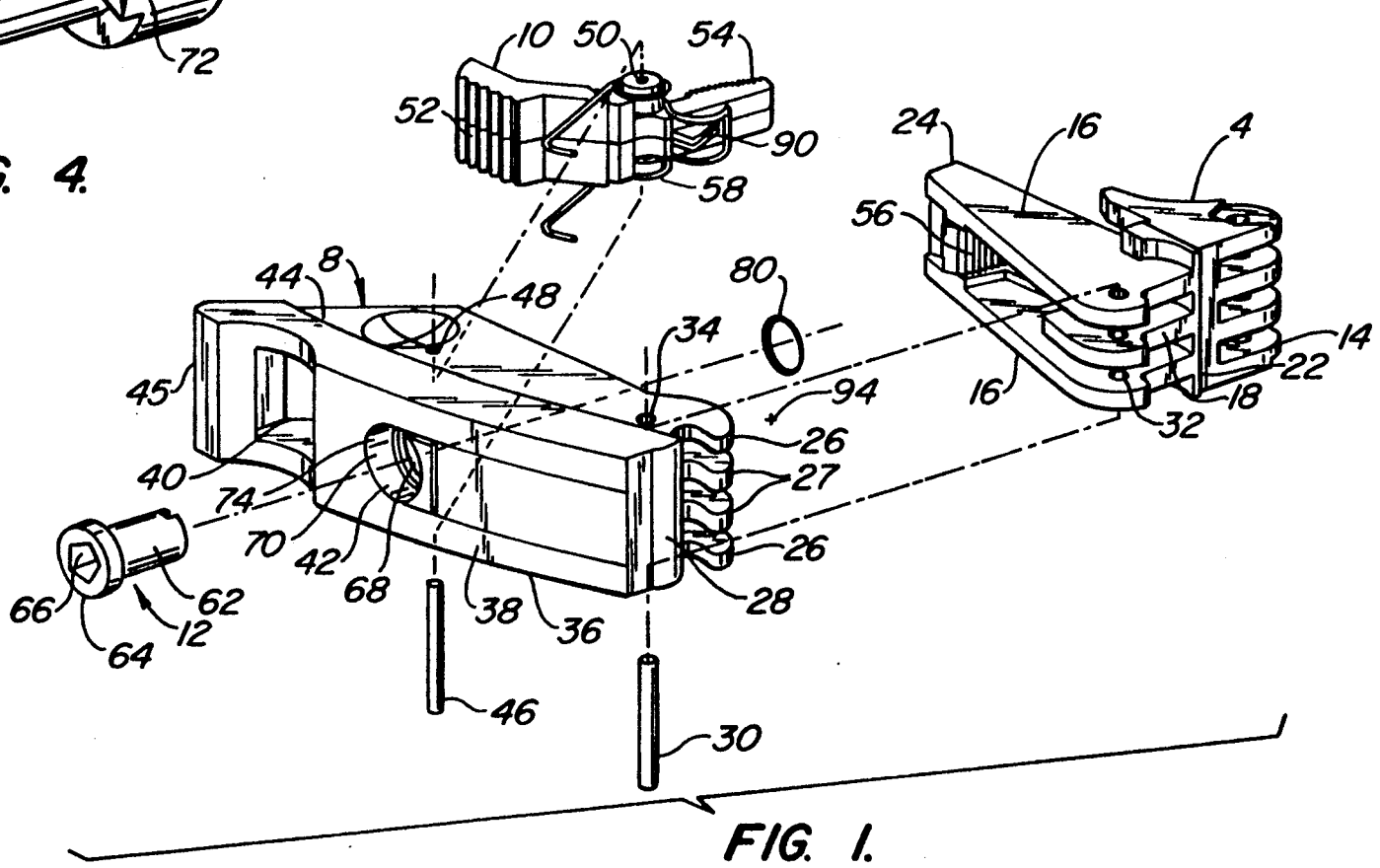
FIG. 1 is an exploded isometric view of a latch/ejector mechanism made according to the invention.
Figure 2:
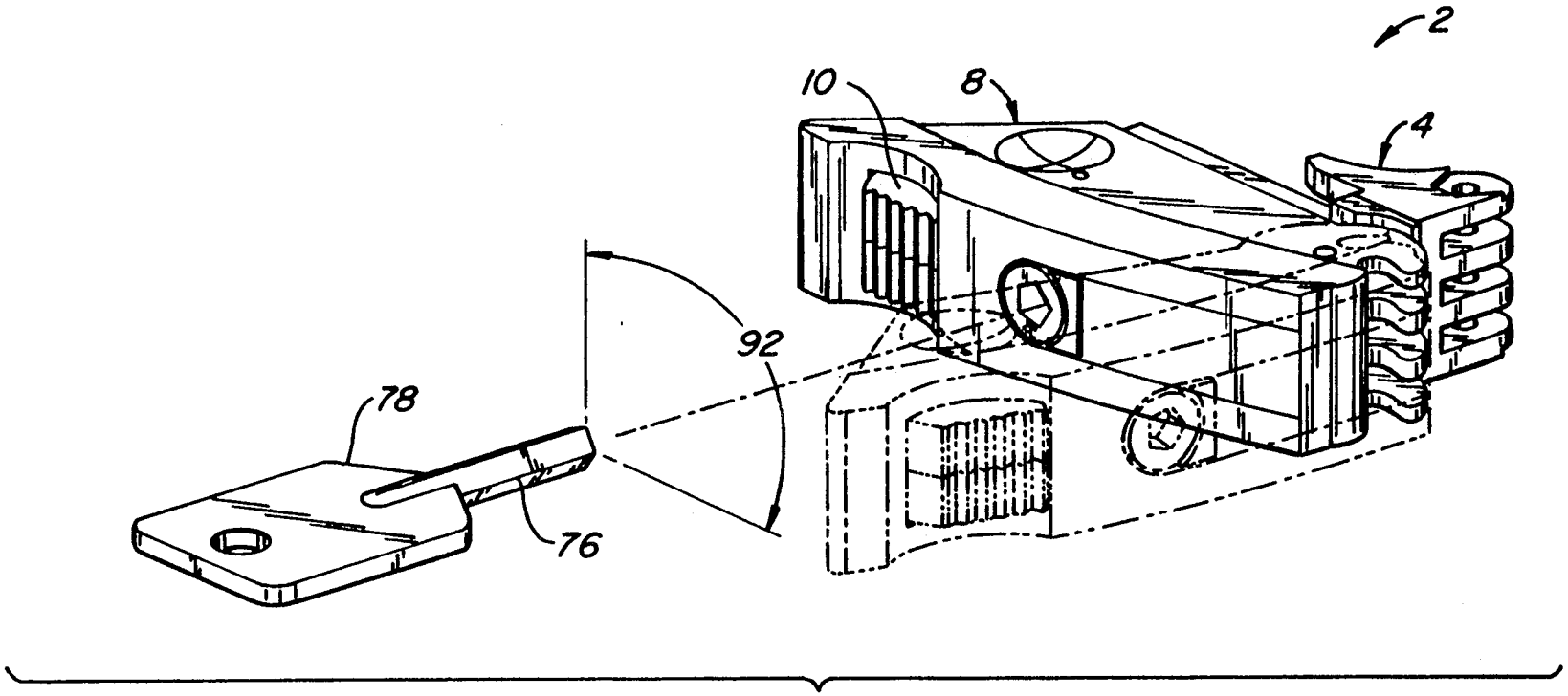
FIG. 2 illustrates the latch/ejector mechanism of FIG. 1 in an assembled condition and a key spaced apart from the security lock, the handle being shown in the unlocked position in phantom.

FIGS. 1 and 2 illustrate a latch/ejector mechanism 2 including a base 4, secured to a component 6 (see FIG. 3), a handle 8 pivotally mounted to base 4, a trigger 10 pivotally mounted to handle 8 and a security lock 12 rotatably mounted to handle 8. As discussed below, security lock 12 is used to prevent the disengagement of trigger 10 with base 4 when in the locked position, thus maintaining handle in the latched position, while permitting trigger 10 to disengage from base 4 when in the unlocked position, thus permitting handle 8 to move from the solid line, latched position of FIGS. 2 and 3 to the unlatched position, the unlatched position shown in phantom in FIG. 2.

Base 4 is mounted to housing 6 using mounting bosses 14 with correspondingly configured mounting structure on housing 6. Although base 4 is shown having this particular configuration, other mounting configurations are possible as well. Base 4 also includes outer flanges 16 extending the length of base 4 and an inner flange 18 extending partway from one end 22 of base 4 towards the other end 24. Flanges 16, 18 are spaced apart to fit between outer and inner flanges 26, 27 at the pivot end 28 of handle 8. Handle 8 is pivotally secured to base 4 through the engagement of flanges 16, 18, 26 and 27 and the passage of a pin 30 through holes 32, 34 formed in flanges 16, 18 of base 4 and flanges 26, 27 of handle 8, respectively. Pin 30 is a force fit within holes 34 while holes 32 are slightly oversized relative to pin 30 to permit handle 8 to pivot about pin 30 relative to base 4, base 4 being stationary relative to housing 6.

Handle 8 includes an elongate body 36 having an outer surface 38 and a pair of through holes 40, 42 formed therethrough. See FIG. 3. Outer flanges 26 extend from the inner surface 44 of body 36 from pivoted end 28 to outer end 45. Trigger 10 is pivotally mounted between outer flanges 26 by use of a pin 46 which passes through holes 48 formed in outer flanges 26 and a bore 50 formed in trigger 10. Holes 46 are slightly undersized relative to the diameter of pin 46 to secure the pin to handle 8. Bore 50 is slightly oversized relative to pin 46 to permit trigger 10 to freely rotate about pin 46.

Trigger 10 is generally doglegged-shaped having a roughened or corrugated finger engaging surface 52 which is positioned within correspondingly shaped hole 40. Trigger 10 also includes a serrated surface 54 sized and positioned to engage a complementarily serrated surface 56 formed at end 24 of base 4 between outer flanges 16. Trigger 10 is rotatable about pin 46 between the solid line, base-engaging position of FIG. 3 and the dashed line, base-released position of FIG. 3. Trigger 10 is biased to the base engaging position by a torsion spring 58 illustrated best in FIG. 1. Serrated surfaces 54, 56 are configured so that when handle 8 is pivoted from the unlatched position, shown in phantom in FIG. 2, to the latched position, trigger 10 pivots slightly in the direction of arrow 60 and serrated surfaces 54, 56 slide over one another until handle 8 assumes the latched position and surfaces 54, 56 engage to keep handle 8 in the latched position.

To prevent unauthorized or inadvertent movement of handle 8 from the latched position to the unlatched position, security lock 12 is used. Security lock 12 has a cylindrical body 62 and an enlarged head 64 with a pentagonal opening 66 formed in the head. Through hole 42 includes a main bore 68 sized for receipt of cylindrical body 62 and an enlarged end 70 sized for receipt of head 64. Head 64 includes a lug 72 which rides within a recess 74 formed in enlarged end 70. Lug 72 defines a circumferential arc of about 20° while recess 74 defines a circumferential arc of about 110°. Thus, when lock 12 is mounted within hole 42 with lug 72 within recess 74, the rotary movement of lock 12 is limited to 90° of rotation. The rotation is achieved by insertion of a complementarily shaped end 76 of a key 78 as suggested in FIG. 2. Security lock 12 is secured within hole 42 by pressing a lock ring 80 over cylindrical body 62 until ring 80 abuts the end 82 of a boss 84 defining main bore 68.

Figure 4:
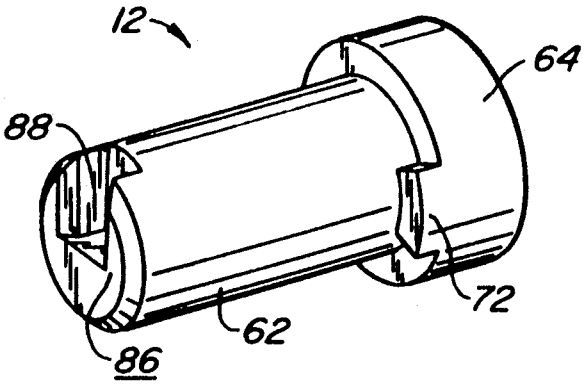
FIG. 4 is an end isometric view of the security lock of FIG. 3 illustrating the lock surface and lock recess.
Figure 3:
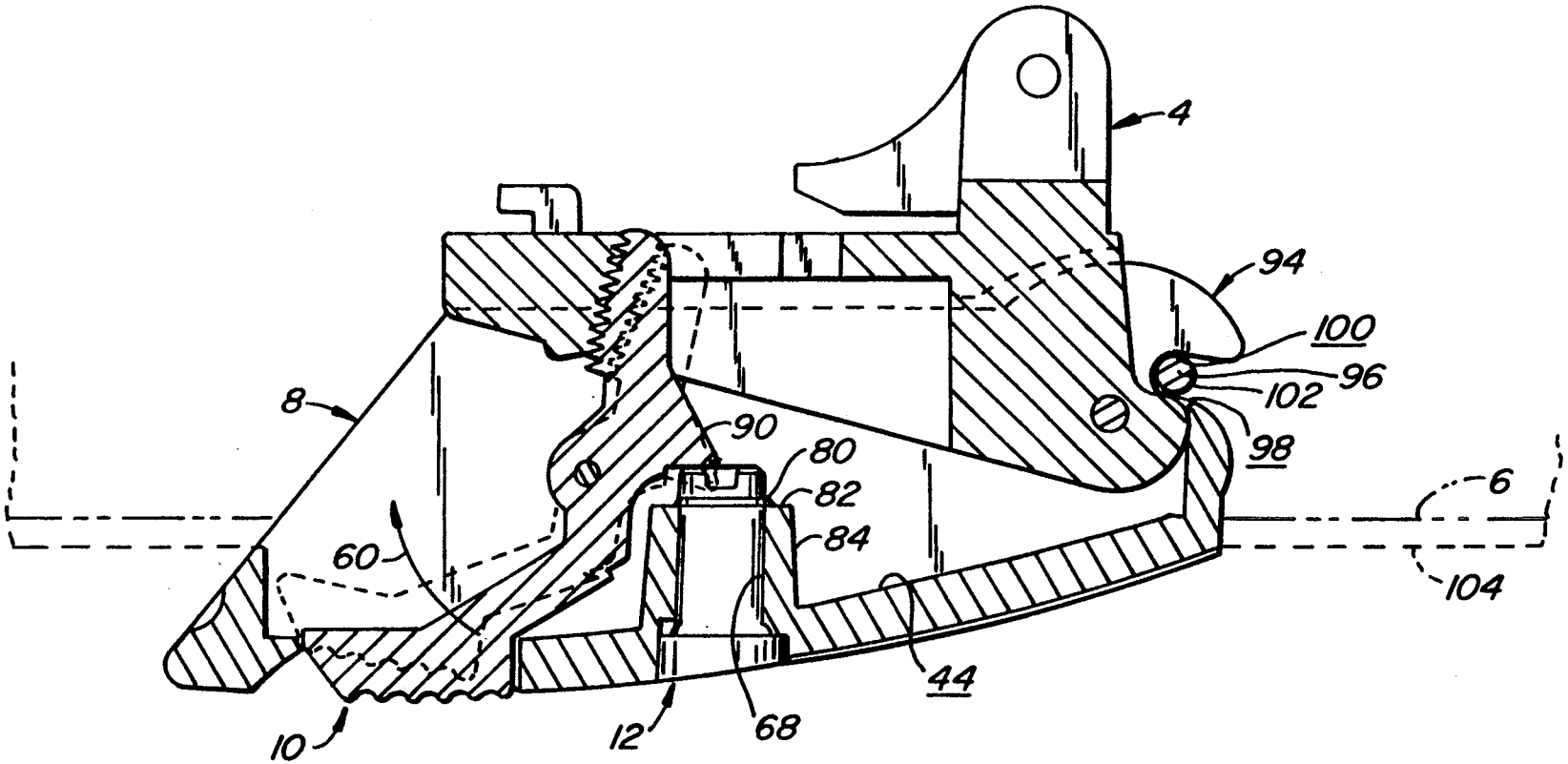
FIG. 3 is a cross-sectional view of the latch/ejector mechanism of FIG. 2 with the security lock in the locked position, the trigger shown in solid lines in its base-engaging position and in dashed lines in its base-released position.

As shown in FIG. 4, security lock 12 includes a lock surface 86 at the end of cylindrical body 62. A lock recess 88 is formed in surface 86. Lock recess 88 is sized to accept at least a portion of a prevent element 90, formed as a wedge-shaped extension of trigger 10. As shown in FIG. 3, with security lock 12 in the locked rotary position, prevent element 90 is opposite lock surface 86 so that pivotal movement of trigger 10 in the direction of arrow 60 is prevented. In this position, serrated surfaces 54, 56 remain engaged thus preventing movement of handle 8 from the solid line position to the phantom line position of FIG. 2. However, inserting end 76 of key 78 into opening 66 and then rotating key 78 ninety degrees in the direction of arrow 92 of FIG. 2 causes lock recess 88 to become aligned with prevent element 90. In this position, the user can press on surface 52 to pivot trigger 10 in the direction of arrow 60 from the solid lined position to the dash line position of FIG. 3. This permits the user to move handle 8 from the solid line, locked position to the phantom line, unlocked position of FIG. 2.

Outer and inner flanges 26, 27 at pivot end 28 define a latch 94 having a U-shaped opening 96. Opening 96 is bounded by an eject surface portion 98 and an insertion surface portion 100 opposite surface portion 98. Flange 94 works in a conventional manner by engaging a catch element 102 of housing 104 and drawing component 6, illustrated schematically by phantom lines in FIG. 3, into housing 104, illustrated schematically by dashed lines in FIG. 3. Ejection occurs when handle 8 is moved from the latched, solid line position of FIGS. 2 and 3 to the unlatched, phantom line position of FIG. 2. Ejection surface portion 98 presses on catch element 102 to help force component 6 from housing 104 in a conventional manner during ejection.

Assuming component 6 is mounted within housing 104 and mechanism 2 is in the position of FIG. 3, to remove component 6 from housing 104, the user first inserts key 78 into opening 66 and rotates the key 90° as suggested by arrow 92. This causes recess 88 to become aligned with prevent element 90. The user then presses on surface 52 to move trigger 10 in the direction of arrow 60 from the solid line position to the dashed line position of FIG. 3 to disengage serrated surfaces 54, 56. Grasping end 45 of handle 8, the user pivots the handle from the solid line position to the phantom line position of FIG. 2, thus driving component 6 a short distance from housing 104 and releasing catch element 102 from U-shaped opening 96 formed by latch 94. The user can now remove component 6 from housing 104. To reposition component 6 within housing 104, handle 8 is placed in the unlatched, phantom line position of FIG. 2 and component 6 is placed into housing 104 until catch element 102 begins to enter opening 96 of latch 94. Handle 8 is then pivoted to the latched position of FIG. 3 during which surface portion 100 engages latch element 102 and pulls component 6 a final distance into housing 104. Security lock 12 is then rotated 90° in the direction opposite arrow 92 using key 78 to place the security lock in the position of FIG. 3, thus preventing unauthorized movement of handle 8.

Modification and variation can be made to the disclosed embodiment without departing from the subject of the invention as defined in the following claims. For example mechanism 2 is shown to include a base 4 mounted to component 6. However, handle 8 could be mounted directly to component 6 so long as component 6 had the appropriate surface for engagement with serrated surface 54 of trigger 10. Other types of locking mechanisms could be used instead of serrated surfaces 54, 56.

What is claimed is:

1. A latch/ejector mechanism for use with a component mountable to a housing, the housing having a catch element, the mechanism comprising:

a handle pivotally mountable to the component for movement between latched and unlatched positions, the handle including latch means for engaging the catch element and pulling the component towards and pushing the component away from the housing when the handle is moved into the latched and unlatched positions respectively;

trigger means for securing the handle in the latched position, the trigger means including means for manually releasing the trigger means to permit the handle to be moved from the latched position to the unlatched position, said trigger means including a trigger pivotally mounted to the handle, the trigger being movable independent of the latch means;

lock means for selectively preventing the trigger means from releasing the handle from the latched position; and the trigger includes a prevent element and the lock means includes a lock surface movable to be aligned with and misaligned with the prevent element.

2. The mechanism of claim 1, wherein the lock means includes a rotatable, generally cylindrical member having an end, the end including the lock surface and a recess formed in the lock surface, the recess and lock surface sized and configured so the prevent element is aligned with the lock surface at one rotary orientation of the cylindrical member and is aligned with the recess at a second rotary orientation of the cylindrical member.

3. The mechanism of claim 2 wherein the cylindrical member includes a second end having a key hole formed therein.

4. The mechanism of claim 3 wherein the handle has an outer surface with an opening formed therein, the opening housing the cylindrical member with the second end generally flush with the outer surface.

5. A latch/ejector mechanism for use with a component mountable to a housing, the housing including a catch element, comprising:

a base mounted to the component;

a handle pivotally mounted to the base, the handle including a latch configured to engage the catch element of the housing, the handle movable between a latched position and an unlatched position;

a trigger having a base engaging portion, the trigger movably mounted to the handle for movement between a base engaging position, at which the handle is prevented from moving between its latched and unlatched positions, and a base released position, at which the handle is free to move between its latched and unlatched positions, the trigger including a prevent element, the trigger being movable independent of the latch; and a lock element mounted to the handle and including a lock surface movable between a locked position aligned with the prevent element to prevent the trigger from moving from the base engaging position to the base released position, and an unlocked position misaligned with the prevent element to permit the trigger to move from the base engaging position to the base released position.

6. The mechanism of claim 5 wherein the lock element is rotatable so the locked and unlocked positions are rotary positions.

7. A latch/ejector mechanism for use with a component mountable to a housing, the housing having a catch element, the mechanism comprising:

a handle pivotally mountable to the component for movement between latched and unlatched positions, the handle including latch means for engaging the catch element and pulling the component towards and pushing the component away from the housing when the handle is moved into the latched and unlatched positions respectively;

trigger means for securing the handle in the latched position, the trigger means including a trigger pivotally mounted to the handle and means for manually releasing the trigger means to permit the handle to be moved from the latched position to the unlatched position;

the trigger including a prevent element;

lock means for selectively preventing the trigger means from releasing the handle from the latched position; and the lock means including a rotatable, generally cylindrical member having first and second ends, the first end including a lock surface and a recess formed in the lock surface, the recess and lock surface sized and configured so the prevent element is aligned with the lock surface at one rotary orientation of the cylindrical member and is aligned with the access at a second rotary orientation of the cylindrical member, the second end having a keyhole formed therein.

8. A latch/ejector mechanism for use with a component mountable to a housing, the housing having a catch element, the mechanism comprising:

a handle pivotally mountable to the component for movement between latched and unlatched positions, the handle including latch means for engaging the catch element when the handle is moved into the latched position;

trigger means for securing the handle in the latched position, the trigger means including means for manually releasing the trigger means to permit the handle to be moved from the latched position to the unlatched position, said trigger means including a base with a first sawtoothed surface, secured to the component, the trigger including a second sawtoothed surface configured for engaging the first sawtoothed surface; and lock means for selectively preventing the trigger means from releasing the handle from the latched position.

9. A latch/ejector mechanism for use with a component mountable to a housing, the housing having a catch element, the mechanism comprising:

a handle pivotally mountable to the component for movement between latched and unlatched positions, the handle including latch means for engaging the catch element and pulling the component towards and pushing the component away from the housing when the handle is moved into the latched and unlatched positions respectively;

the handle including a trigger pivot;

trigger means for securing the handle in the latched position, the trigger means including means for manually releasing the trigger means to permit the handle to be moved from the latched position to the unlatched position, said trigger means including a trigger pivotally mounted to the handle at the trigger pivot, the trigger being movable independent of the latch means, the trigger being housed substantially within the handle; and lock means for selectively preventing the trigger means from releasing the handle from the latched position.

10. A latch/ejector mechanism for use with a component mountable to a housing, the housing having a catch element, the mechanism comprising:

a handle pivotally mountable to the component for movement between latched and unlatched positions, the handle including latch means for engaging the catch element and pulling the component towards and pushing the component away from the housing when the handle is moved into the latched and unlatched positions respectively;

the handle including a trigger pivot;

trigger means for securing the handle in the latched position, the trigger means including means for manually releasing the trigger means to permit the handle to be moved from the latched position to the unlatched position, said trigger means including a trigger pivotally mounted to the handle at the trigger pivot, the trigger being movable independent of the latch means, the trigger also including a serrated surface configured to engage the housing; and lock means for selectively preventing the trigger means from releasing the handle from the latched position.

* * * * *